US006880910B2

(12) United States Patent
Tominaga

(10) Patent No.: US 6,880,910 B2
(45) Date of Patent: Apr. 19, 2005

(54) AIR DAMPER, INK JET HEAD, AND INK JET RECORDING APPARATUS

(75) Inventor: Kazuyoshi Tominaga, Chiba (JP)

(73) Assignee: SII Printek Inc., Chiba (JP)

( * ) Notice: Subject to any disclaimer, the term of this patent is extended or adjusted under 35 U.S.C. 154(b) by 0 days.

(21) Appl. No.: 10/607,297

(22) Filed: Jun. 26, 2003

(65) Prior Publication Data

US 2004/0027427 A1 Feb. 12, 2004

(30) Foreign Application Priority Data

Aug. 12, 2002 (JP) ..... 2002-234679

(51) Int. Cl.[7] ..... B41J 2/015; B41J 2/17; B41J 2/175

(52) U.S. Cl. ..... 347/20; 347/84; 347/85; 347/86; 347/87

(58) Field of Search ..... 347/20, 84, 85, 347/86, 87, 94

(56) References Cited

U.S. PATENT DOCUMENTS 4,935,751 A * 6/1990 Hamlin ..... 347/86
6,017,118 A * 1/2000 Gasvoda et al. ..... 347/86
6,485,137 B1 * 11/2002 Karlinski et al. ..... 347/92
6,817,707 B1 * 11/2004 Fowler et al. ..... 347/86

FOREIGN PATENT DOCUMENTS

EP 0 927 638 A2 * 7/1999 ..... B41J/2/175

* cited by examiner

*Primary Examiner*—Stephen D. Meier
*Assistant Examiner*—Alfred Dudding
(74) *Attorney, Agent, or Firm*—Adams & Wilks

(57) ABSTRACT

An air damper for use with an ink jet head has a main body having an ink reservoir portion, and a film sealed to the main body and covering the ink reservoir portion to define therewith an ink reservoir. A reinforcement plate is attached to the main body and overlies the film to prevent rupture of the film due to expansion thereof when the ink jet head is pressure-filled with ink. The reinforcement plate has a recessed portion opposed to and facing the film to permit limited expansion of the film caused by pressure fluctuations of ink in the ink reservoir.

17 Claims, 5 Drawing Sheets

AIR DAMPER, INK JET HEAD, AND INK JET RECORDING APPARATUS

BACKGROUND OF THE INVENTION

1. Field of the Invention

The present invention relates to an air damper for generating a negative pressure in a head chip which is applicable to, for example, a printer or a facsimile, and to an ink jet head and an ink jet recording apparatus.

2. Description of the Related Art

Up to now, an ink jet recording apparatus has been known in which an ink jet head for discharging ink from plural nozzles is employed to record characters and/or images on a recording medium. In this type of ink jet recording apparatus, an entirety of the desired area is printed by repeating the following operations. That is, a carriage mounted with the ink jet head is moved in a main scanning direction with respect to the recording medium while the ink is discharged from a nozzle of the ink jet head, thereby printing a dot pattern in a predetermined area; and after one main scanning operation ends, the recording medium is moved in a sub-scanning direction by a predetermined amount.

In a large ink jet recording apparatus, plural ink jet heads corresponding to respective ink colors are mounted to the carriage. This type of large ink jet recording apparatus in which the heads are mounted to the carriage and the carriage moves in the main scanning direction is called a "shuttle type recording apparatus". The so-called shuttle type recording apparatus is structured such that, in order to perform a large amount of printing for a long period of time, an exchangeable large-capacity ink cartridge is incorporated in the apparatus and connected to the corresponding head through a tube to supply ink. In a method of supplying ink using a tube, when a carriage moves, the ink residing inside the tube moves therein in accordance with the movement of the carriage. When the ink moves, inertia is generated inside the head connected to the tube. Then, a differential pressure due to the inertia inside the head results in breakage of a meniscus that is formed by surface tension of the ink in a nozzle hole provided in a nozzle surface of the head. Thus, the ink cannot be discharged. In view of the above, a part called an "air damper" is generally mounted so as to relax the pressure fluctuation due to the inertia of the ink. In order to relax the pressure fluctuation, one side of the air damper is molded from a rigid body such as plastic to have a recessed portion for storing ink, and a film-shaped sheet is then bonded thereto by thermal welding or the like so as to seal the recessed portion. The film moves due to the pressure fluctuation of the ink in accordance with the movement of the carriage, thereby relaxing the pressure fluctuation of the ink.

If the large ink jet recording apparatus is employed, it is necessary to increase a length of the tube for supplying the ink from the ink cartridge. The longer tube increases a flow path resistance inside the tube to disturb flow of the ink. Also, if an outside air temperature becomes low, viscosity of the ink increases to harden the ink. Thus, smooth flow of the ink is hindered under only an ordinary suction pressure. There can be employed another method of supplying ink by providing a sub-tank in the vicinity of a head. However, a larger apparatus becomes necessary, which leads to higher costs.

Up to now, in order to fill the head with the ink, the following method has been employed. That is, a cap formed of rubber is brought in press contact with a nozzle plate of the head to seal an inside portion between the nozzle plate and the cap. Another tube is attached to an exhaust port provided to the cap which communicates with an external portion. Due to suction by a pump via the another tube, a negative pressure is generated inside a space between the cap and the nozzle plate. As a result, the head is filled with the ink via the tube from an ink cartridge. In this type of ink supplying method, the ink is sucked by only suction from the head side. Thus, if the longer tube is used, the head cannot be smoothly filled with the ink due to the generated flow path resistance.

In view of this, there has been proposed an additional method of filling the head with the ink such that the ink is forced to be pushed out from the ink cartridge side by another pump different from the above pump. However, if being pressurized from the ink cartridge side by using this method, the pressure increases inside the air damper attached to the head which relaxes the inertia of the ink inside the tube, so that the film bonded to the air damper by thermal welding or the like is ruptured due to the internal pressure in some cases.

SUMMARY OF THE INVENTION

In light of the above circumstances, the present invention has an object to provide a relatively simple structure in which ink can pressure-fill a head.

In order to solve the above problems, according to a first aspect of the present invention, there is provided an air damper including a reinforcement plate for preventing rupture of a film of the air damper.

According to a second aspect of the present invention, there is provided an air damper in which the reinforcement plate is formed of a transparent plastic plate.

According to a third aspect of the present invention, there is provided an air damper in which the reinforcement plate includes on its film side a recessed portion for accepting deformation of the film caused by fluctuation in the ink inside the air damper which is generated when the head moves.

According to a fourth aspect of the present invention, there is provided an air damper in which the reinforcement plate includes one or plural air holes for, in a case where a liquid surface inside the air damper fluctuates at the time of pressure fluctuation in accordance with the movement of a carriage, introducing air between the reinforcement plate and the film to relax the pressure fluctuation.

According to a fifth aspect of the present invention, there is provided an air damper in which the reinforcement plate is fixed to the air damper with plural screws.

According to a sixth aspect of the present invention, in any one of the first to fourth aspects, there is provided an air damper in which the reinforcement plate is fixed to the air damper by ultrasonic welding or the like.

According to a seventh aspect of the present invention, there is provided an air damper further including recessed portions formed in right and left side surfaces or three surfaces of the right and left side surfaces and another surface of a main body of the air damper, in which: the reinforcement plate includes undercut portions to be fitted to the recessed portions of the air damper; and the reinforcement plate is fixed by inserting the undercut portions into the recessed portions of the air damper.

DETAILED DESCRIPTION OF THE PREFERRED EMBODIMENTS

Hereinafter, embodiments of the present invention will be described in detail with reference to the drawings.

Figure 1:
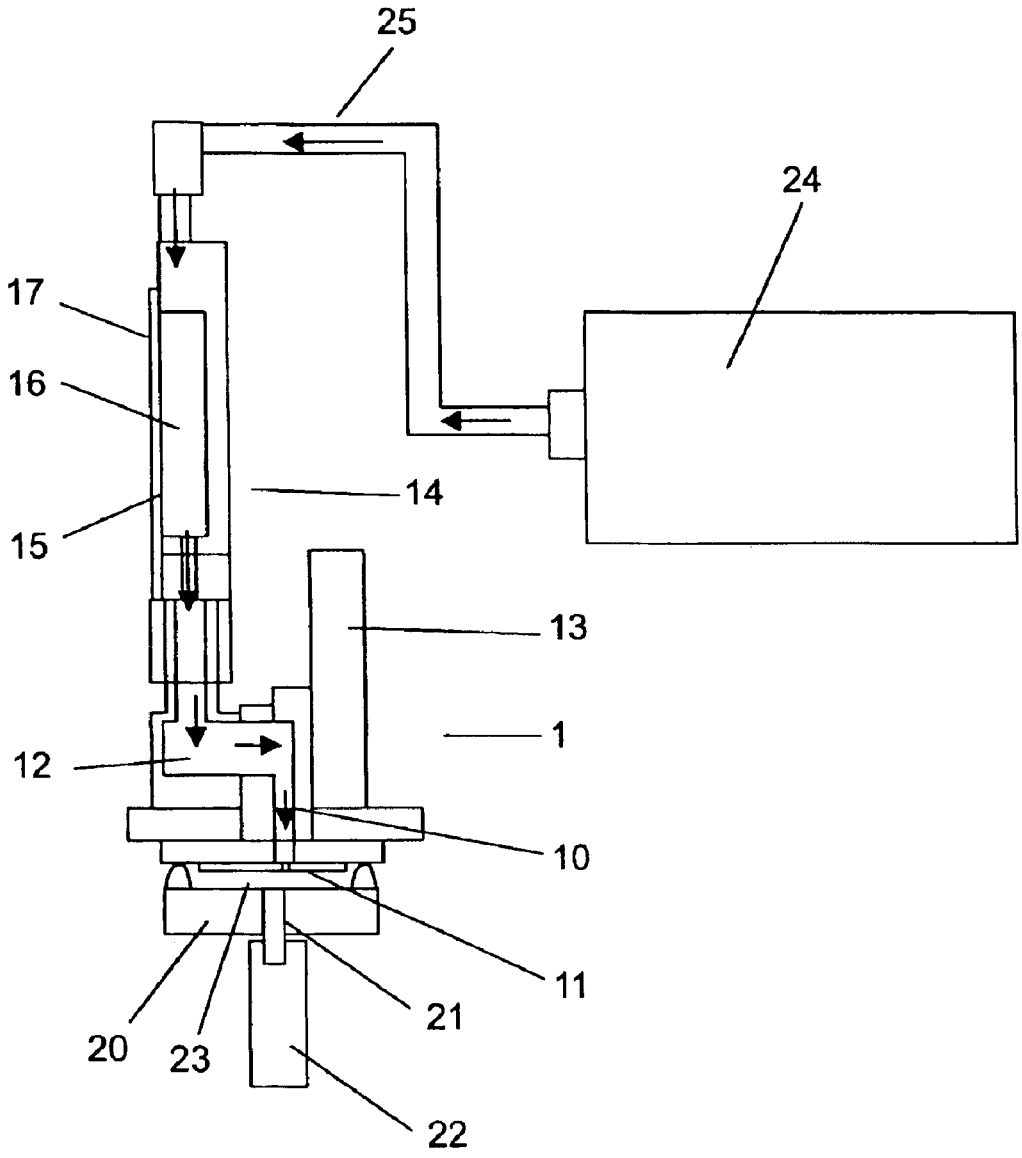
FIG. 1 is a schematic view showing an attachment part of an air damper of the present invention.
Figure 2:
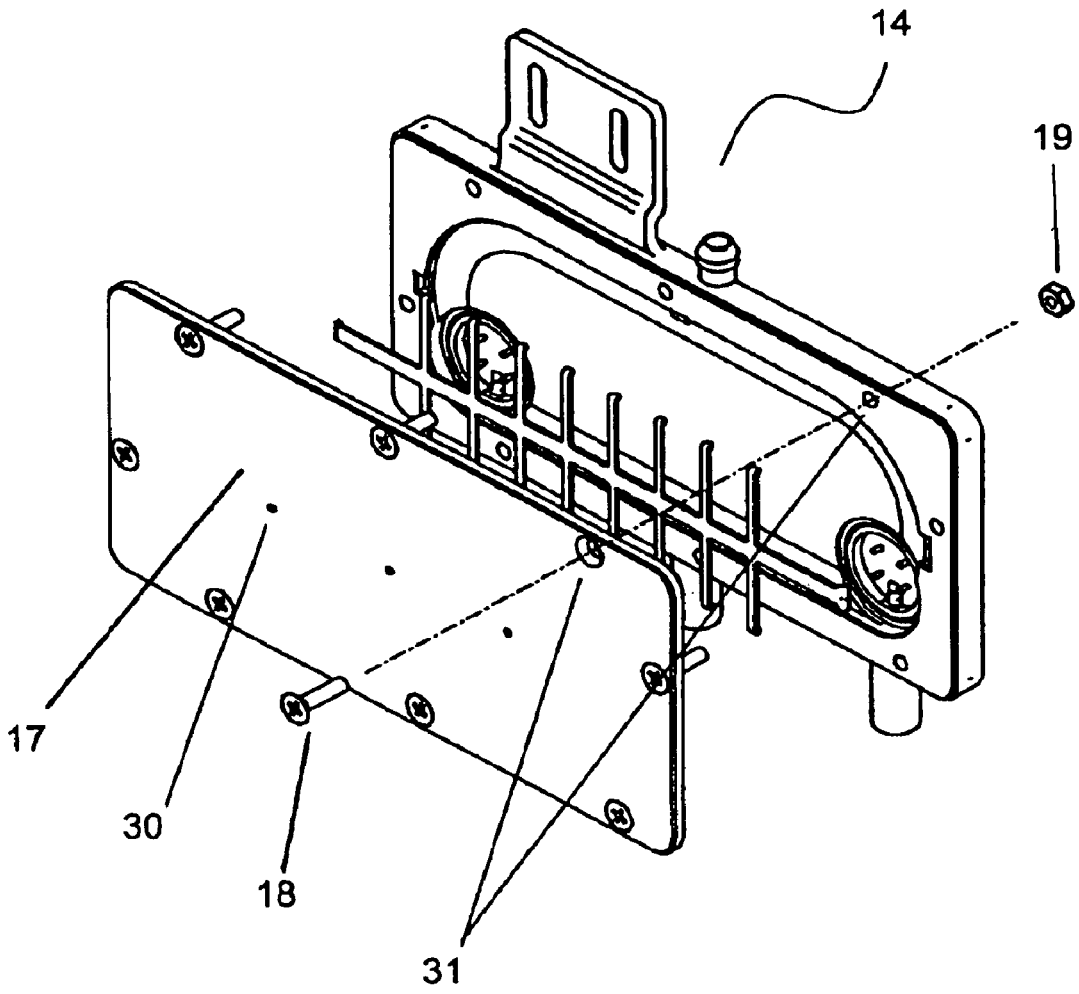
FIG. 2 is an exploded structural view showing a structure of the air damper of the present invention.

FIG. 1 is a schematic view showing a part mounted with an air damper of the present invention, and FIG. 2 is an exploded structural view showing a structure of the air damper of the present invention. Further, FIG. 3 is a perspective view showing an external shape of an ink jet head mounted with the air damper.

Figure 3:
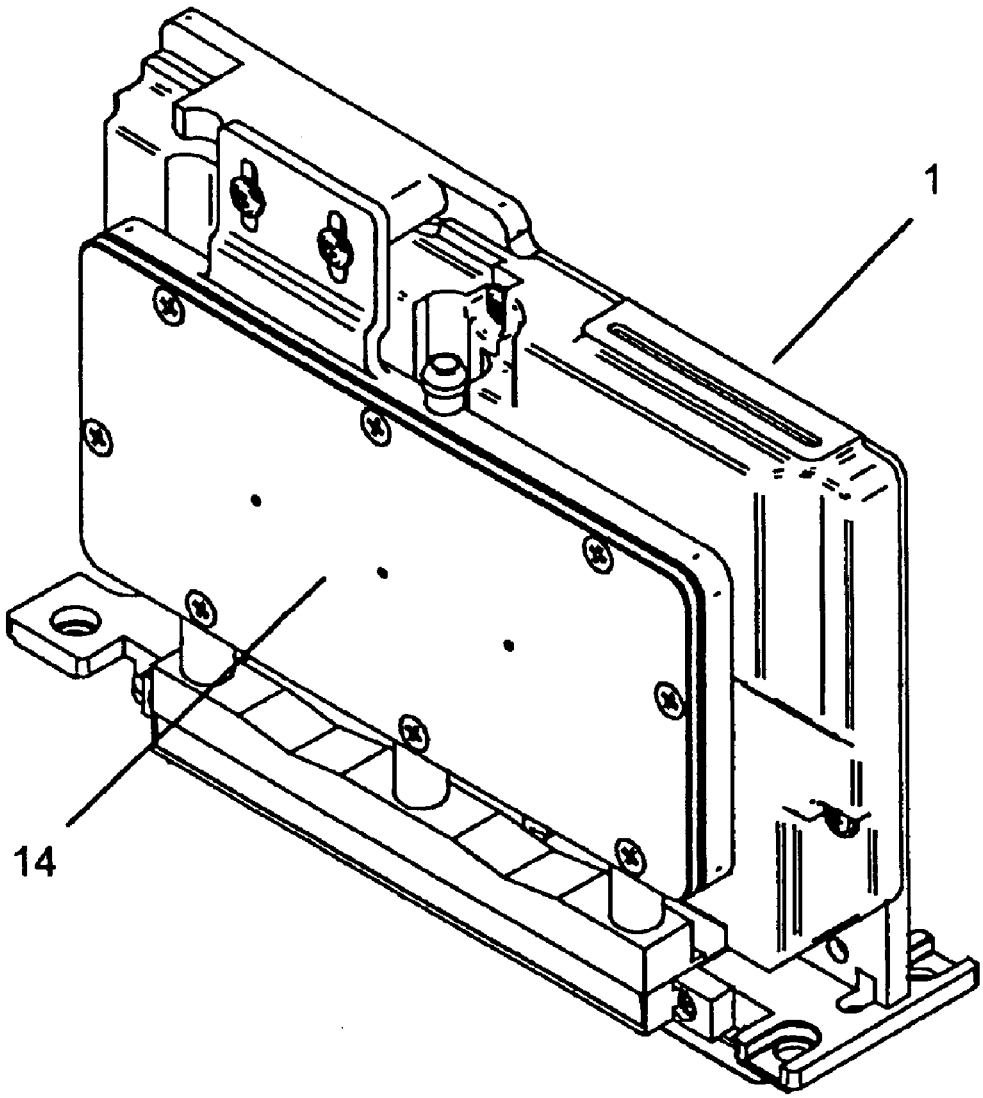
FIG. 3 is a perspective view showing an external shape of an ink jet head mounted with the air damper of the present invention.

As shown in FIGS. 1 to 3, an ink jet head 1 in accordance with the present invention is composed of a head chip 10 made of PZT, a nozzle plate 11 provided at a front end of the head chip 10 and having a hole for discharging ink, a flow path 12 for supply the ink to an inside of the head chip 10, a base 13 for supporting various parts, an air damper 14, and the like.

In an ink jet recording apparatus of the present invention, the ink is supplied to the head 1 by the following process. That is, a cap 20 formed of rubber is brought in press contact with the nozzle plate 11 of the head 1 to seal an inside portion between the nozzle plate 11 and the cap 20. A tube 22 is attached to an exhaust port 21 provided to the cap 20 which communicates with an external portion. Due to suction by a not-shown pump via the tube 22, a negative pressure is generated inside a space 23 between the cap 20 and the nozzle plate 11. As a result, the head 1 is filled with the ink via a tube 25 from an ink cartridge 24 along the path shown by the arrows in FIG. 1.

An ink reservoir portion 16 of the air damper 14 is structured to be sealed by fixing a polyester film 15 or the like to an air damper main body over an entire surface of the ink reservoir portion 16 by thermal welding, ultrasonic welding, adhesion, or the like. As described above, in a case where the head 1 is filled with the ink, if an ink discharging portion of the head 1 is sealed with the cap 20 and the negative pressure is generated on a head 1 side, the ink in the ink cartridge 24 is made to flow into the air damper 14 via the ink tube 25. If the air damper 14 is filled with the ink, the head 1 is next filled with the ink, the ink is then jetted from the nozzle plate 11, and air inside the head 1 is pushed out from the exhaust port 21 of the cap 20. As a result, preparation of printing is complete.

Figure 4:
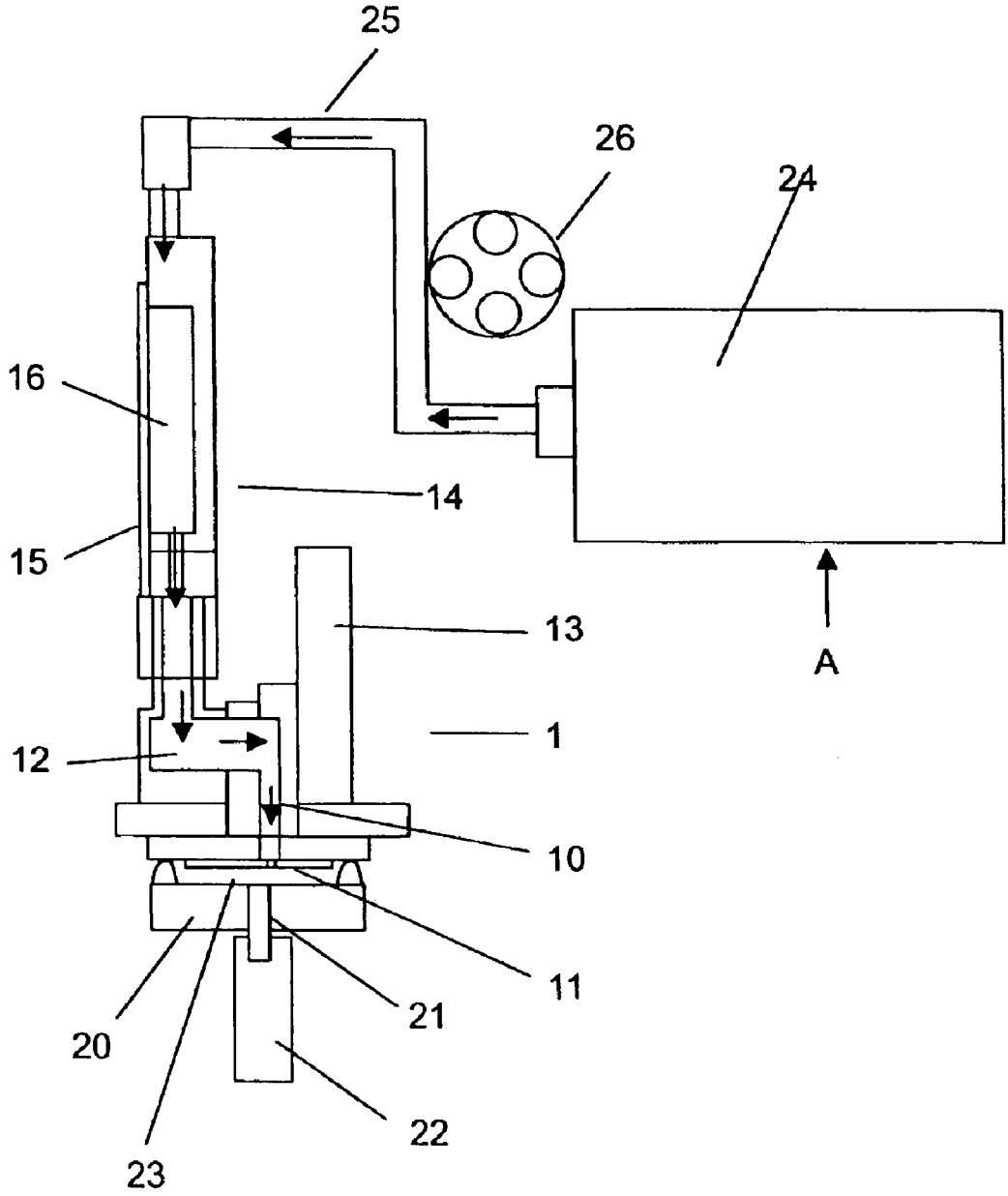
FIG. 4 is an explanatory view showing how ink is pressure-supplied to the air damper of the present invention.

In the case where the ink has a high viscosity or the viscosity of the ink increases at a low temperature, a sufficient amount of ink cannot be supplied by an ordinary suction process. Such insufficient ink supply causes ink shortage and residual air inside the head 1, so that the ink cannot be normally discharged from the head 1. In this case, not only the suction process but also the following process may be employed. That is, as shown in FIG. 4, the cartridge 24 is directly pressurized in a direction shown by the arrow A to push out the ink. Alternatively, the tube 25 is pressed by a pump 26 to push out the ink from the tube 25. Thus, the air damper 14 is rapidly filled with the ink, thereby making it possible to fill the head 1 with the ink.

In this case, if the ink reservoir portion 16 with only the film 15 is pressure-filled with the ink, the film 15 bulges or expands toward the external portion. If the film 15 bulges or expands to such an extent that a tension of the film 15 reaches or exceeds its maximum tension and an adhesive force at an adhesive boundary between the air damper 14 main body and the film 15, the film 15 can be ruptured. Also, if the film 15 bulges at the time of pressurization, a pressure for pushing out the ink decreases and there is a case where efficient pressure-filling cannot be performed.

In order to suppress deficiency due to the bulging or expansion of the film 15 and transmit the pressure efficiently, as shown in FIG. 2, the air damper 14 of the present invention employs a structure in which a reinforcement plate 17 is fixed onto a not-shown film surface so as to prevent or limit the film 15 from bulging. The reinforcement plate 17 can be formed of plastic or a metal plate. At the time of pressurization, a pressure of 1 to 2 atm is applied to the air damper 14, so that the reinforcement plate 17 has rigidity enough to withstand the pressure at the time of pressure-filling of the ink. It is necessary that the reinforcement plate 17 formed of plastic has a thickness of 2 mm or more and the reinforcement plate 17 formed of a sheet metal has a thickness of 1 mm or more. For firm fixation, it is further necessary to use screws 18 and nuts 19 to fix the reinforcement plate 17 robustly. For this purpose, fixation holes 31 for fixing the reinforcement plate 17 are formed in the reinforcement plate 17 and the air damper 14. Also, one or plural small air holes 30 may be formed in the reinforcement plate 17 in the region where the film 15 covers the ink reservoir portion 16 (see FIGS. 2–3) such that, in the case where a liquid surface inside the air damper 14 fluctuates at the time of pressure fluctuation in accordance with the movement of a carriage to thereby inhibit a movement of the film 15, air is introduced between the reinforcement plate 17 and the film 15, thereby making it possible to relax the pressure fluctuation. If respective structural parts disassembled as shown in FIG. 2 are reassembled, the head 1 according to this embodiment as shown in FIG. 3 is complete.

Figure 5:
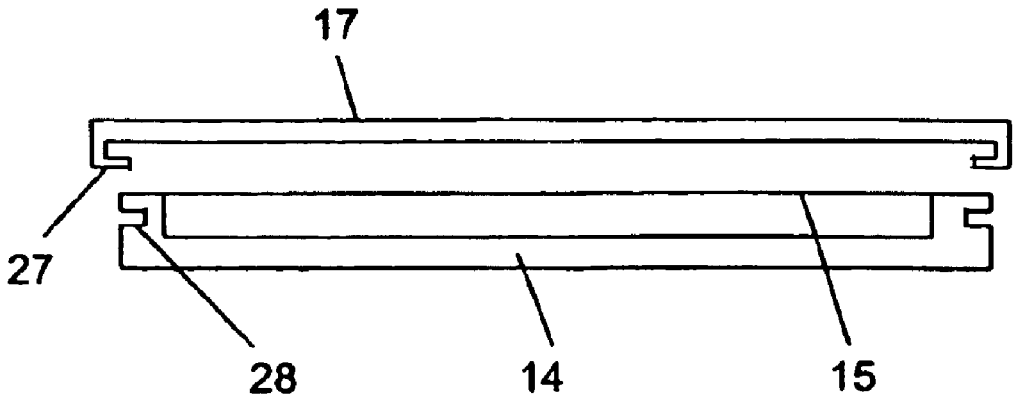
FIG. 5 shows one embodiment in a case where a reinforcement plate is attached to the air damper of the present invention.

In this embodiment, the screws 18 and the nuts 19 are connected via the through holes 31 of the air damper 14 and the reinforcement plate 17 to fix the reinforcement plate 17. However, it is also possible to fix the reinforcement plate 17 by using the air damper 14 main body insert-molded with nuts or using self-tapping screws. Alternatively, in another method, as shown in FIG. 5, U-shaped undercut portions 27 are formed in side surfaces of the reinforcement plate 17 while recessed portions 28 to be fitted to the undercut portions 27 are formed in the air damper 14. Therefore, the undercut portions 27 may be inserted into the recessed portions 28 to fix the reinforcement plate 17. Similarly in this method, the fixation may require use of screws in some cases.

Figure 6:
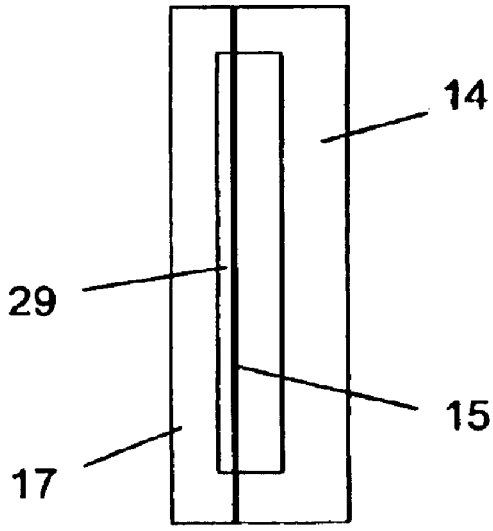
FIG. 6 shows another embodiment in the case where the reinforcement plate is attached to the air damper of the present invention.

Further, as another method of attaching the reinforcement plate 17, as shown in FIG. 6, the reinforcement plate 17 may be fixed to the main body of the air damper 14 by ultrasonic welding or the like. In this case, the movement of the film 15 of the air damper 14 is regulated by the reinforcement plate 17. Thus, a recessed portion 29 may be formed in the surface of the reinforcement plate 17 opposed to and facing the film 15 to permit limited bulging or expansion of the film so that the film 15 can easily fluctuate. Note that, in this case, if the recessed portion 29 has a depth that is too large, the film 15 adheres to the recessed portion 29 of the reinforcement plate 17 or deforms due to the pressure at the time of pressurization. Thus, the depth of the recessed portion 29 is suitably set within the range of 0.3 to 1 mm.

As has been described above, according to the present invention, the head can be filled with the ink by pressurization and suction simultaneously. Also, in the case where the ink has a high viscosity or the viscosity of the ink increases at a low temperature, the head can be easily filled with the ink.

Hereinabove, the description has been made of the embodiments of the present invention. However, the present invention is not limited to the aforementioned structures and any modifications and variations may be made thereto without departing from the gist of the present invention as disclosed herein and claimed as appended herewith.

What is claimed is:

1. An air damper for use with a movable ink jet head for storing ink and relaxing fluctuations in supplying the ink due to inertia generated when the ink jet head moves, the air damper comprising:

a main body having an ink reservoir portion;

a film body attached to the main body and covering the ink reservoir portion to form therewith an ink reservoir; and a reinforcement plate disposed over the film body to prevent rupture of the film body and connected to the main body such that the film body is interposed between the main body and the reinforcement plate, the reinforcement plate having a first recessed portion opposed to and facing the film body for accepting deformation of the film body caused by fluctuation of the ink inside the air damper generated when the ink let head moves.

2. An air damper according to claim 1, wherein the reinforcement plate is formed of one of plastic and a sheet metal.

3. An air damper according to claim 2, wherein the reinforcement plate is fixed to the main body with plural screws.

4. An air damper according to claim 2, wherein the reinforcement plate is fixed to the main body by ultrasonic welding.

5. An air damper according to claim 1, further comprising second recessed portions formed in right and left side surfaces or three surfaces of the right and left side surfaces and another surface of the main body; and wherein the reinforcement plate includes undercut portions inserted into the second recessed portions to connect the reinforcement plate to the main body.

6. An ink jet head having the air damper according to claim 1.

7. An ink jet recording apparatus having the ink jet head according to claim 6.

8. An air damper for use with a movable ink jet head for storing ink and relaxing fluctuations in supplying the ink due to inertia generated when the ink let head moves, the air damper comprising:

a main body having an ink reservoir portion;

a film body attached to the main body and covering the ink reservoir portion to form therewith an ink reservoir; and a reinforcement plate disposed over the film body to prevent rupture of the film body and connected to the main body such that the film body is interposed between the main body and the reinforcement plate, the reinforcement plate having one or more air holes for, in a case where a liquid surface inside the air damper fluctuates at the time of pressure fluctuation in accordance with movement of the ink let head, introducing air between the reinforcement plate and the film body to relax the pressure fluctuation.

9. An air damper according to claim 6, further comprising recessed portions formed in right and left side surfaces or three surfaces of the right and left side surfaces and another surface of the main body; and wherein the reinforcement plate includes undercut portions inserted into the recessed portions to connect the reinforcement plate to the main body.

10. An air damper for use with an ink jet head, the air damper comprising: a main body having an ink reservoir portion; a film sealed to the main body and covering the ink reservoir portion to define therewith an ink reservoir; and a reinforcement plate disposed over the film and connected to the main body, the reinforcement plate having a recessed portion opposed to and facing the film to permit limited expansion of the film caused by pressure fluctuations of ink in the ink reservoir during use of the air damper.

11. An air damper according to claim 10, wherein the reinforcement plate has one or more air holes extending therethrough in a region where the film covers the ink reservoir portion.

12. An air damper according to claim 10, wherein the reinforcement plate is comprised of sheet metal having a thickness of 1 mm or more.

13. An air damper according to claim 10, wherein the reinforcement plate is comprised of plastic having a thickness of 2 mm or more.

14. An air damper according to claim 10, wherein the reinforcement plate has undercut portions inserted in recessed portions of the main body to connect the reinforcement plate to the main body.

15. An air damper according to claim 10, wherein the recessed portion of the reinforcement plate has a depth not more than 1 mm.

16. An ink jet head having an air damper according to claim 10.

17. An ink jet head recording apparatus having an ink jet head according to claim 16.

* * * * *